US009885349B2

(12) United States Patent
Smith

(10) Patent No.: US 9,885,349 B2
(45) **Date of Patent: *Feb. 6, 2018**

(54) PUMPING UNIT AND COUNTERBALANCE SYSTEM FOR PUMPING UNITS

(71) Applicant: Guidemaster Manufacturing Corp., Odessa, TX (US)

(72) Inventor: Alan D. Smith, Odessa, TX (US)

(73) Assignee: Guidemaster Manufacturing Corp., Odessa, TX (US)

( * ) Notice: Subject to any disclaimer, the term of this patent is extended or adjusted under 35 U.S.C. 154(b) by 271 days.

This patent is subject to a terminal disclaimer.

(21) Appl. No.: 14/617,887

(22) Filed: Feb. 9, 2015

(65) Prior Publication Data

US 2015/0219090 A1 Aug. 6, 2015

Related U.S. Application Data

(63) Continuation of application No. 13/097,754, filed on Apr. 29, 2011, now Pat. No. 8,950,473.

(60) Provisional application No. 61/332,766, filed on May 8, 2010.

(51) Int. Cl.
*E21B 43/12* (2006.01)
*F04B 47/14* (2006.01)

(52) U.S. Cl.
CPC ..... *F04B 47/14* (2013.01); *E21B 43/127* (2013.01); *Y10T 16/82* (2015.01); *Y10T 74/18182* (2015.01); *Y10T 74/2156* (2015.01)

(58) Field of Classification Search
CPC .. E21B 43/127; F04B 47/14; Y10T 74/18182; Y10T 74/2156
See application file for complete search history.

(56) References Cited

U.S. PATENT DOCUMENTS 2,308,823 A * 1/1943 Phipps ..... F04B 47/02 267/174

* cited by examiner

*Primary Examiner* — Brad Harcourt

(57) ABSTRACT

A counterbalance system may include an outrigger support structure, a first elongated outrigger member, and a second elongated outrigger member. The outrigger support structure is adapted to be mounted in an operating position on a walking beam of a pumping unit. The first elongated outrigger member is connected to the outrigger support structure at a first lateral side of the counterbalance system. The second outrigger member is also connected to the outrigger support structure, but is connected at a second lateral side of the counterbalance system. A first suspension element may be connected to the first outrigger member and a second suspension element may be connected to the second outrigger member. Suitable counterbalance weights may be connected to the first suspension element while additional counterbalance weights may be connected to the second suspension element. These counterbalance weights connected to the first and second suspension elements may be used to counterbalance the weight on the downhole weight on the walking beam.

20 Claims, 7 Drawing Sheets

PUMPING UNIT AND COUNTERBALANCE SYSTEM FOR PUMPING UNITS

CROSS-REFERENCE TO RELATED APPLICATIONS

This is a continuation of U.S. patent application Ser. No. 13/097,754 filed Apr. 29, 2011, and entitled "Cross-Jack Counterbalance System," which claimed the benefit of U.S. Provisional Patent Application 61/332,766 filed May 8, 2010 of the same title. The Applicant claims the benefit of U.S. patent application Ser. No. 13/097,754 under 35 U.S.C. § 120, and claims the benefit of U.S. Provisional Patent Application No. 61/332,766 under 35 U.S.C. § 119(e). The entire content of each of these prior patent applications is incorporated herein by this reference.

TECHNICAL FIELD OF THE INVENTION

The present invention relates pumping units such as those used for artificial lift in oil wells. More particularly, the invention relates to counterbalance systems for use with pumping units as well as to pumping units which incorporate the counterbalance systems.

BACKGROUND OF THE INVENTION

In the field of oil and gas production, a reciprocating beam pumping unit or "pumpjack" (referred to herein simply as a "pumping unit") is a form of counterbalanced reciprocating device used to drive a downhole pump to lift reservoir fluids in wells with insufficient bottom-hole pressure to lift reservoir fluids to the surface at a desired production rate. The pumping unit is an above ground drive unit that includes a rotating motor to drive a crankshaft (typically through a reducing gear arrangement) and a suitable linkage arrangement between the crankshaft and a walking beam. In operation, the walking beam is driven to pivot back and forth about a suitable pivot structure to provide an effective mechanical reciprocating motion to drive the downhole reciprocating pump. The downhole pump can be within the well hundreds or even thousands of feet below the surface. The connection to the above ground pumping unit is through a series of elongated interconnected rods known as sucker rods which extend typically through a string of production tubing from the surface to the location of the downhole pump. The reciprocating action of the above ground pumping unit raises and lowers the entire length of the sucker rods to drive the downhole pump to lift reservoir fluids which have entered the well bore.

On each upstroke of the pumping unit, the pumping unit must lift not only the entire length of sucker rods and the reciprocating portion of the downhole pump, but also the entire column of reservoir fluids in the production tubing. The weight lifted with each stroke can sometimes exceed twenty thousand pounds. As a practical matter, lifting such weight requires a counterweight arrangement on the pumping unit. One type of counterweight arrangement includes counterweights located on the walking beam, opposite the pivot point from the downhole weight. These "beam-balanced" pumping units suffer from reduced stroke length and reduced pump capacity. Also, they become relatively unbalanced at larger angles of walking beam tilt. Therefore, they have been limited to use in relatively shallow wells. Another type of counterweight arrangement, which can be used with or without counterweights located on the walking beam, includes counterweights located on the rotating crankshaft of the driving reduction gear. In these "crank-balanced" pumping units the rotation of the counterweights mounted on the crankshaft has a horizontal force vector in all but the twelve and six o'clock positions. Reducing this to horizontal and vertical vectors only, fifty percent (50%) of the work used to move the counterweights is horizontal, and thus ineffective. Because the drive unit directly effects counterweight movement and indirectly moves the rod-pump complex through the walking beam, only the vertical forces on the counterweights produce vertical movement on the downhole pump components. Thus fifty percent (50%) of the power drive unit work expended in a crank-balanced pumping unit can be ineffective in pump output. Frequency driving the drive motor for the pumping unit differentially in different portions of the rotational cycle can reduce power consumption during less vertically efficient portions of the rotational stroke cycle. However, because the vertical and horizontal components cannot be completely isolated, the reduction of ineffective power consumption is limited.

Even with prior art counterweight arrangements, driving the pumping unit requires considerable energy input from the motor, which is commonly an electric motor. Because the upward stroke of the pumping unit and downhole reciprocating pump produce a relatively low volume of pumped fluids, between 5-40 liters per stroke, long runtimes for these pumps can consume relatively large amounts of energy. This energy consumption is part of the calculated "lift cost," which reflects the relative efficiency and profitability of such production wells.

Attempts to improve artificial lift systems which utilize a pumping unit have included improvements in materials of construction, design improvements in critical components such as bearing surfaces, reduction gearing, variations in counter-weight balancing, stroke mechanics and overall harmonics of rotary and reciprocal actions, and the use of frequency drive systems to more efficiently match mechanical harmonics to motor drive output throughout the pump cycle. Also, reducing downhole weights which must be lifted with each pumping cycle by use of lighter weight components can reduce pumping work directly. The benefits of lighter weight downhole components sometimes are off-set by increased failure rates and reduced capacity.

SUMMARY OF THE INVENTION

The current invention includes a counterbalance system to counterbalance the downhole weight connected to a reciprocating pumping unit to more efficiently offset the vertical translations of the downhole weights with each stroke of the reciprocating pump unit. This substantially eliminates a significant portion of ineffective work associated with previous pumping units, thus reducing the overall work of pumping, energy consumption, and, consequently, lift costs.

A counterbalance system within the scope of the present invention may be used with a pre-existing pumping unit, or may be integrated with a newly manufactured pumping unit. Thus the present invention encompasses counterbalance systems for use with pumping units and to new or retrofitted pumping units including such a counterbalance system. The present invention also encompasses methods for counterbalancing a pumping unit.

In one embodiment of the present invention, a counterbalance system includes an outrigger support structure, a first elongated outrigger member, and a second elongated outrigger member. The outrigger support structure is adapted to be mounted in an operating position on a walking beam of a pumping unit. In this operating position the outrigger support structure extends transverse to the walking beam from a first lateral side of the counterbalance system at a first side of the walking beam to a second lateral side of the counterbalance system at a second side of the walking beam opposite the first side of the walking beam. The outrigger support structure has a mounting axis which aligns in a vertical plane with the longitudinal axis of the walking beam when the outrigger support structure is mounted in the operating position on the walking beam. The first elongated outrigger member is connected to the outrigger support structure at the first lateral side of the counterbalance system with a suspension end of the first outrigger member positioned on the first lateral side of the counterbalance system. The second outrigger member is also connected to the outrigger support structure, but is connected at the second lateral side of the counterbalance system with a suspension end of the second outrigger member positioned on the second lateral side of the counterbalance system. Both the first outrigger member and the second outrigger member are connected to the outrigger support structure so that the respective longitudinal axis of each outrigger member extends along the mounting axis. A first suspension element may be connected to the first outrigger member so as to depend from the suspension end of the first outrigger member when the outrigger support structure is in the operating position. A second suspension element may be connected to the second outrigger member so as to depend from the suspension end of the second outrigger member when the outrigger support structure is in the operating position. Suitable counterbalance weights may be connected to the first suspension element while additional counterbalance weights may be connected to the second suspension element. These counterbalance weights connected to the first and second suspension elements may be used to counterbalance the downhole weight on the walking beam.

As will be discussed further below in connection with the drawings, a counterbalance system according to this embodiment allows the downhole weight on the walking beam to be counterbalanced without requiring horizontal movement of the counterweights. Reducing or eliminating horizontal movement of the counterweights reduces the load on the pumping unit motor and thus reduces the power consumed by the pumping unit motor to reduce lift cost.

In another aspect of the invention a first outrigger complex which includes the first outrigger member and a second outrigger complex which includes the second outrigger member may be mounted together with the outrigger support structure to improve the efficiency of the pumping unit. In particular, the first outrigger complex, the second outrigger complex, and the outrigger support structure may be mounted on the walking beam so that the first and second outrigger beams are positioned below the level of the walking beam and axially along the walking beam so as to place the center of gravity of a combined walking beam complex, outrigger support structure, first outrigger complex, and second outrigger complex at a pivot axis for the walking beam of the pumping unit.

As used in this disclosure and the accompanying claims, the term "walking beam complex" is used to refer to the walking beam and elements which may be connected to the walking beam other than the present counterbalance system and the downhole weight. In particular, the walking beam complex includes a structure known as a "horse head" connected to the walking beam and from which the downhole weight is suspended in operation of the pumping unit. Also, the terms "first outrigger complex" and "second outrigger complex" will be used to refer to the respective outrigger member and additional elements supported by the respective outrigger member other than the counterweights. In particular the first outrigger complex may include a first counterbalance head from which counterweights are suspended, and the second outrigger complex may include a second counterbalance head from which counterweights are suspended.

The placement of the center of gravity of the combined walking beam complex, outrigger support structure, first outrigger complex, and second outrigger complex at or near the pivot axis for the walking beam reduces induced torques in the pumping unit arising from the misalignment of the center of gravity of the walking beam and the pivot axis of the walking beam which is present in many pumping units. This reduction in induced torques reduces the power requirements of the pumping unit and thus reduces lift costs.

Embodiments of a counterbalance system in accordance with the present invention do not preclude the use of frequency driving to summarily improve efficiency. Furthermore, embodiments of a counterbalance system within the scope of the invention do not require significant changes in a pre-existing pumping unit. Removal of the crankshaft counterweights (which can be used on the present counterbalance system counterweights) with rebalancing of the pumping unit with the present counterbalance system in place are all that is required to effect the gain in efficiency. In scaled prototype studies the gain in efficiency was well over fifty percent (50%). In addition to lift cost savings through reduced energy consumption, unloading the crankshaft loads can reduce maintenance costs and increase component longevity and reduce component failure.

In another aspect of the present invention, adjustable heads may be used as the counterbalance heads for the first and second outrigger members. In particular, counterbalance heads may include an arrangement for adjusting the curvature of the face of the head to minimize or eliminate horizontal movement of the counterweights suspended from the first and second outrigger members. Also, the curved adjustable head may be mounted so that it may be tilted with respect to the end of the respective outrigger beam and can be raised or lowered to adjust for vertical height with respect to the center of pivot. An adjustable head as disclosed herein may be used not only as a counterbalance head but also as the head connected at the front end of the walking beam, independent of a counterbalance system as disclosed herein.

These and other advantages and features of the invention will be apparent from the following description of illustrative embodiments, considered along with the accompanying drawings.

DESCRIPTION OF ILLUSTRATIVE EMBODIMENTS

Figure 2:
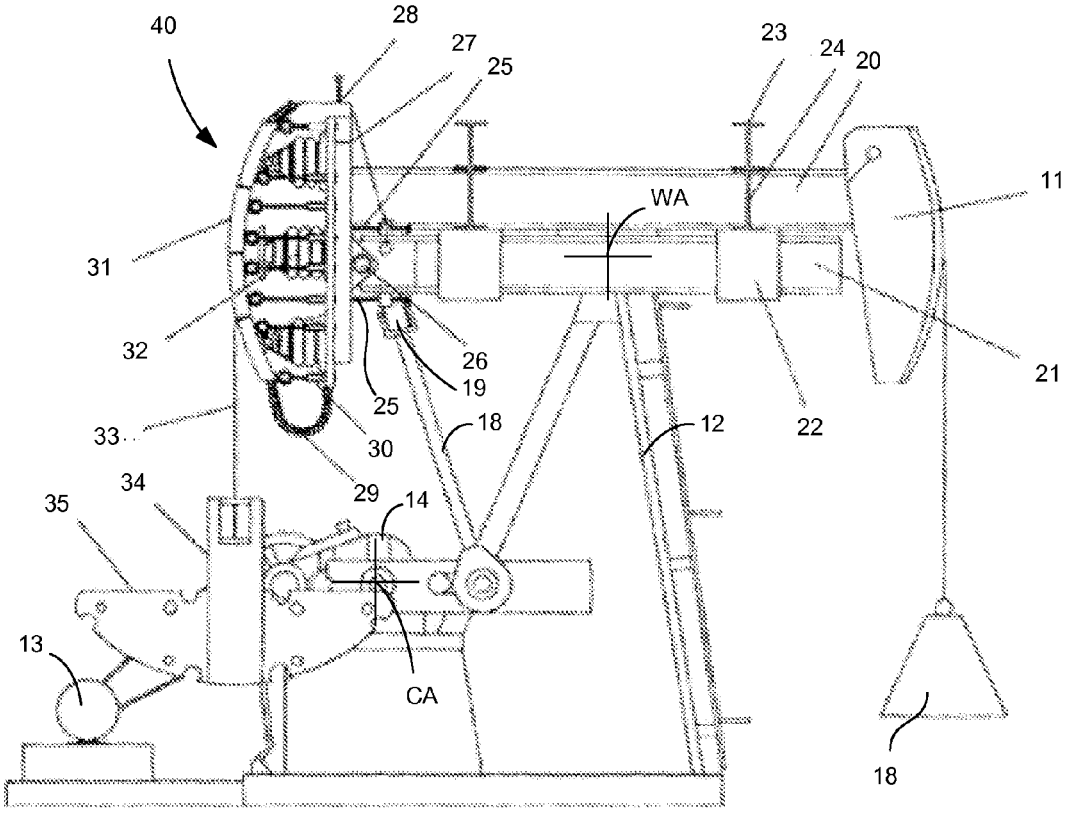
FIG. 2 is a schematic side view of the pumping unit of FIG. 1 with a counterbalance system according to one embodiment of the present invention mounted in an operating position.
Figure 3:
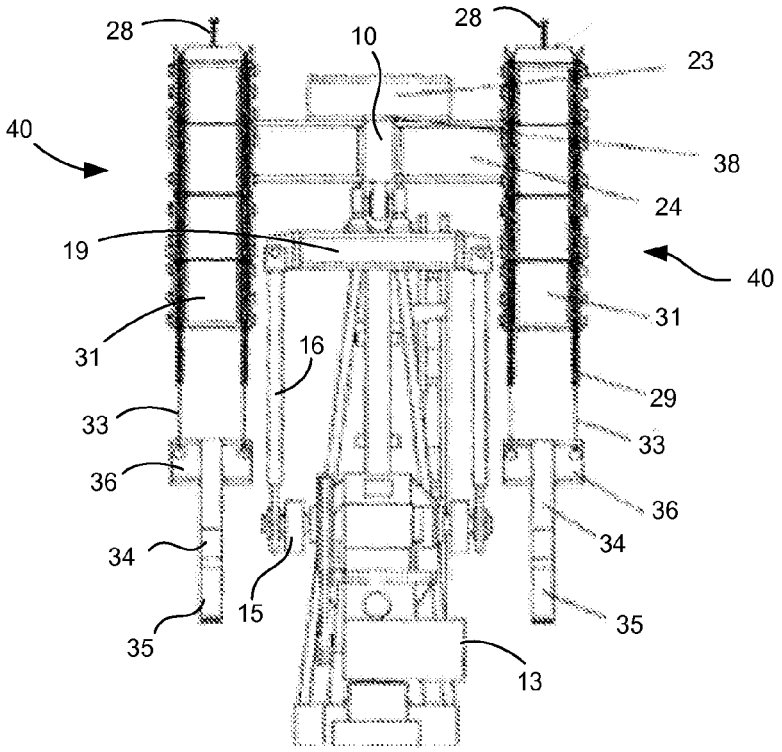
FIG. 3 is a schematic rear view of the pumping unit and counterbalance system shown in FIG. 2.
Figure 4:
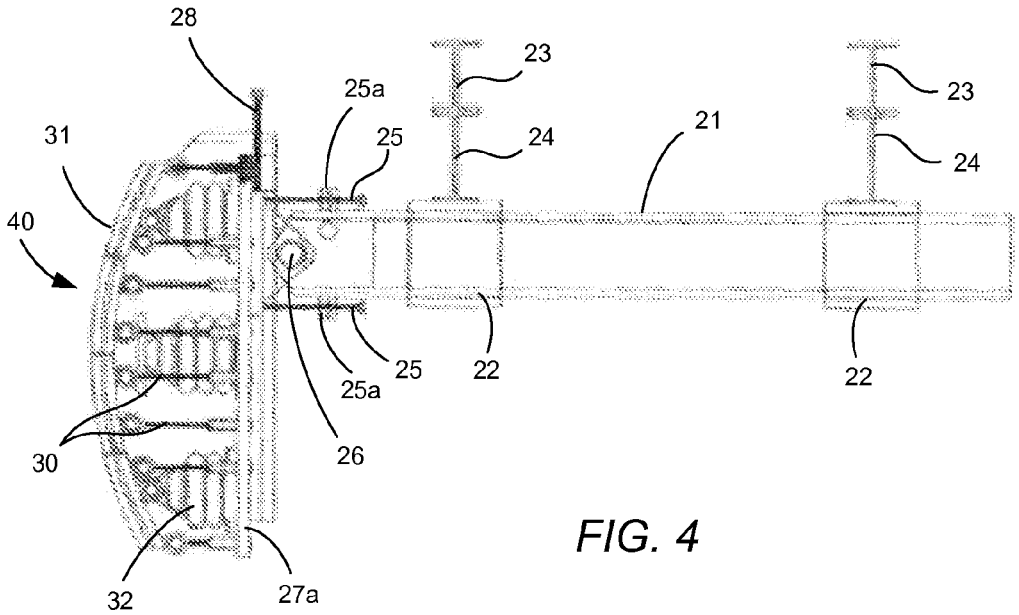
FIG. 4 is a schematic side view of the counterbalance system shown in FIGS. 2 and 3.

In the following description FIG. 1 will be used to describe a prior art pumping unit and to illustrate aspects of the prior art pumping unit which lead to certain operational inefficiencies. FIGS. 2 and 3 will then be used to describe a counterbalance system according to certain embodiments of the present invention as mounted in an operating position on the prior art pumping unit of FIG. 1. FIGS. 4-8 show the example counterbalance system separate from a pumping unit.

Figure 1:
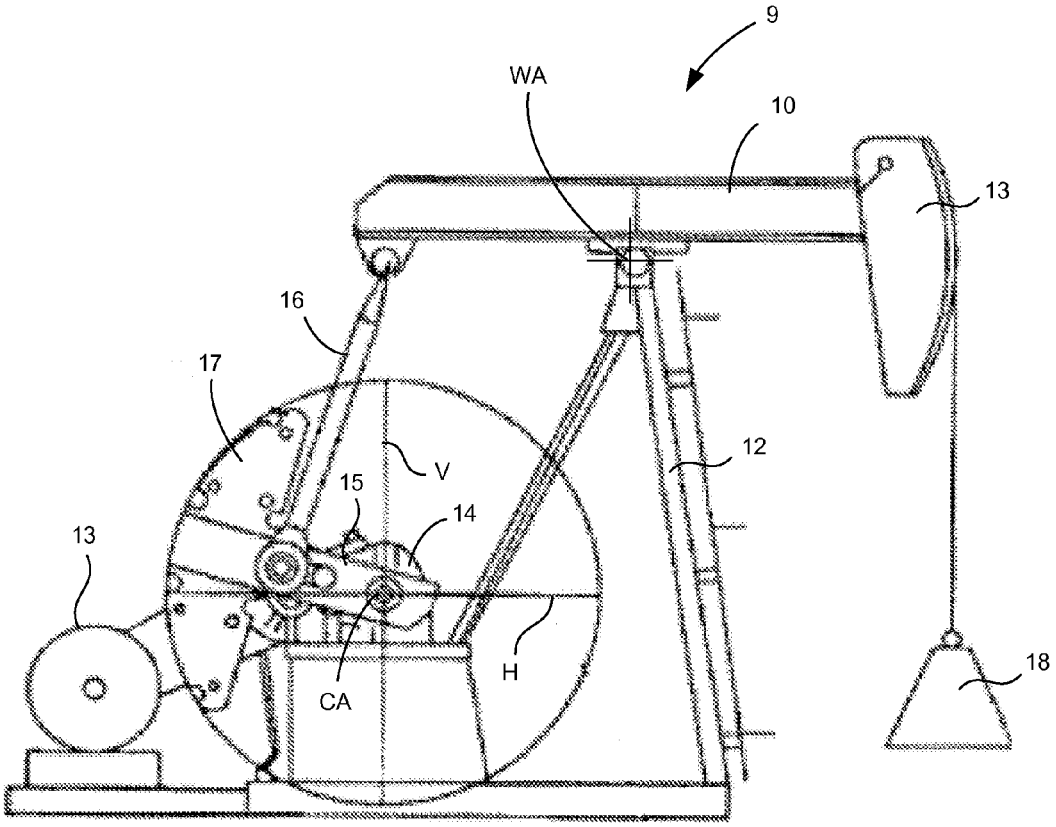
FIG. 1 Prior Art
FIG. 1 is a schematic representation of a prior art pumping unit showing the translational vectors of counterweight movement with each pump stroke.

Referring to FIG. 1, a pumping unit 9 includes a walking beam 10 pivotally mounted on a walking beam support 12 (also referred to as a "Samson post"). In this arrangement, walking beam 10 may pivot about a walking beam axis WA extending perpendicular to the plane of the drawing. A horse head 11 is connected at a front end of walking beam 10. Pumping unit 9 also includes a motor 13 (also may also be referred to as a "prime mover") which is operably connected via a drive belt to a reducing gear arrangement 14. In operation, motor 13 drives a crank 15 about a crankshaft axis CA. The lower end of a Pitman arm 16 is connected to the crank 15 via a suitable bearing arrangement and the upper end of the Pitman arm is connected with a pivoting arrangement to walking beam 10. In this prior art crank-balanced pumping unit 9 a counterbalance weight 17 is connected to the crank arm 15 to provide a counterbalance for the downhole weight which is suspended from horse head 11 and illustrated diagrammatically as weight 18.

Although not apparent from the side view of FIG. 1, it should be appreciated that a separate crank arm is connected to the reducing gear crankshaft at the opposite side of the reducing gear 14 to which crank arm 15 is connected. This opposite side crank arm carries its own counterweight similar to counterweight 17 and is connected for reciprocating the walking beam 10 by an additional Pitman arm connected to the opposite side crank arm. The two spaced apart Pitman arms are connected to a transverse member commonly known as an "equalizer bar" which provides the desired linkage between the Pitman arms and walking beam 10 (the equalizer bar 19 is shown in the view of FIG. 3).

As motor 13 drivers reducing gear 14 to rotate crank 15 and the opposite side crank about axis CA, the connection between Pitman arm 16 (and the opposite side Pitman arm) and walking beam 10 causes a reciprocating pivoting motion in the walking beam 10 about walking beam axis WA. The vertical motion about the curved face of horse head 11 imparts a vertical reciprocating motion on the downhole weight, which, in an actual implementation of a pumping unit, comprises a string of sucker rods, reciprocating downhole pump components, and a column of reservoir fluids in the well above the level of the downhole pump.

FIG. 1 also shows a circle centered on crankshaft axis CA which indicates the arc of movement of counterweight 17 as crank 15 pivots about crankshaft axis CA in the course of operation of pumping unit 9. A horizontal line H in FIG. 1 indicates the horizontal deviation of counterweight 17 as it rotates about crankshaft axis CA, while a vertical line V shows the vertical deviation of the counterweight as it rotates about axis CA.

FIG. 1 further shows how walking beam 10 is mounted above walking beam pivot axis WA in the prior art pumping unit 9. This mounting of walking beam 10 above walking beam pivot axis WA necessarily places the center of gravity of the walking beam complex at a point which is offset from walking beam pivot axis WA (the walking beam complex being made up of walking beam 10 and horse head 11 along with the equalizer bar (not shown in FIG. 1) at the rear of the walking beam to which the Pitman arms connect). This placement of the walking beam complex center of gravity at a point offset from the walking beam pivot axis WA causes induced torques as the walking beam pivots in its pumping cycle about walking beam axis WA. As noted in the summary section and as will be described further below, a counterbalance system according to some embodiments of the present invention may be mounted on a walking beam such as walking beam 10 so as to effectively shift the center of gravity of the walking beam complex and mounted elements of the counterbalance so that it aligns with the walking beam pivot axis WA.

Referring to FIGS. 2-6, a counterbalance system according to one embodiment of the present invention includes first and second outrigger members 21 supported parallel to each other on either side of walking beam 10 by outrigger mounts 22. In the illustrated embodiment the outrigger members 21 are longitudinally slideable through mounts 22 so that the outrigger members can be positioned and adjusted longitudinally to effect the balance desired between the counterweight system and downhole weight across pivot axis WA. Because the outrigger members 21 are connected in this embodiment so as to straddle pivot axis WA fore and aft, the outrigger members may be structurally substantial to support the counterweights described further below without unduly complicating the balance of the composite weights across pivot axis WA.

Each outrigger member 21 terminates on the end opposite horse head 11 of walking beam 10 in mounting components which attach a respective counterbalance head 40 to that end of the respective outrigger member. The end of the respective outrigger member 21 to which the respective counterbalance head is attached may be referred to as the suspension end of the respective outrigger member. In the illustrated example embodiment of the counterbalance system, each counterbalance head 40 comprises an adjustable head structure and the mounting components for the respective counterbalance head allows further adjustments as will be described further below. A respective counterbalance weight, in this illustrated case made up of counterweight components 34, 35, and 36, is suspended from the respective counterbalance head 40 by suspensor cables 33 which comprise the counterbalance system suspension elements in this form of the invention.

As shown particularly in FIG. 2, outrigger members 21 (one on either side of walking beam 10) are positioned by an outrigger support structure made up of transverse beams 23 and 24 below the vertical level of walking beam pivot axis WA. The composite weights of the outrigger members 21 and other components making up each outrigger complex below the vertical level of pivot axis WA combined with the weights associated with the walking beam complex may be used to produce a center of gravity for the combined structure that corresponds to walking beam pivot axis WA. This reduces unwanted, induced torque forces as the walking beam tilts without mounting the walking beam 10 itself differently on walking beam support 12. This adjustment of the center of gravity of the combined structure of the walking beam complex, support structure (beams 23, 24, and mounts 22), and each outrigger member complex (each made up of a respective outrigger member 21 and counterbalance head 40) can dramatically reduce the work associated with articulating the loaded walking beam 10.

The outrigger member mounts 22 are part of the outrigger support structure which connect the outrigger members 21 to the walking beam 10 and are located on either side of walking beam fore and aft of pivot axis WA in the illustrated embodiment. These structurally substantial, channel-like mounts 22 on a respective side of walking beam 10 focally encase and support the respective outrigger member 21 while allowing the outrigger member to slide within the channels to adjust the longitudinal position of the outrigger member relative to the mounts. The each mount 22 is attached on a respective lateral side of the counterbalance system to the outrigger support structure, and particularly to a respective end of transverse beam 24 of the outrigger support structure. In total, the illustrated embodiment includes four mounts 22; two on opposite sides of pivot axis WA (and two on either side of the walking beam 10). To fix the respective outrigger member 21 at the desired longitudinal position on mounts 22, the mounts may incorporate fixation screws (not shown) which engage the respective outrigger beam in a suitable fashion.

Figure 5:
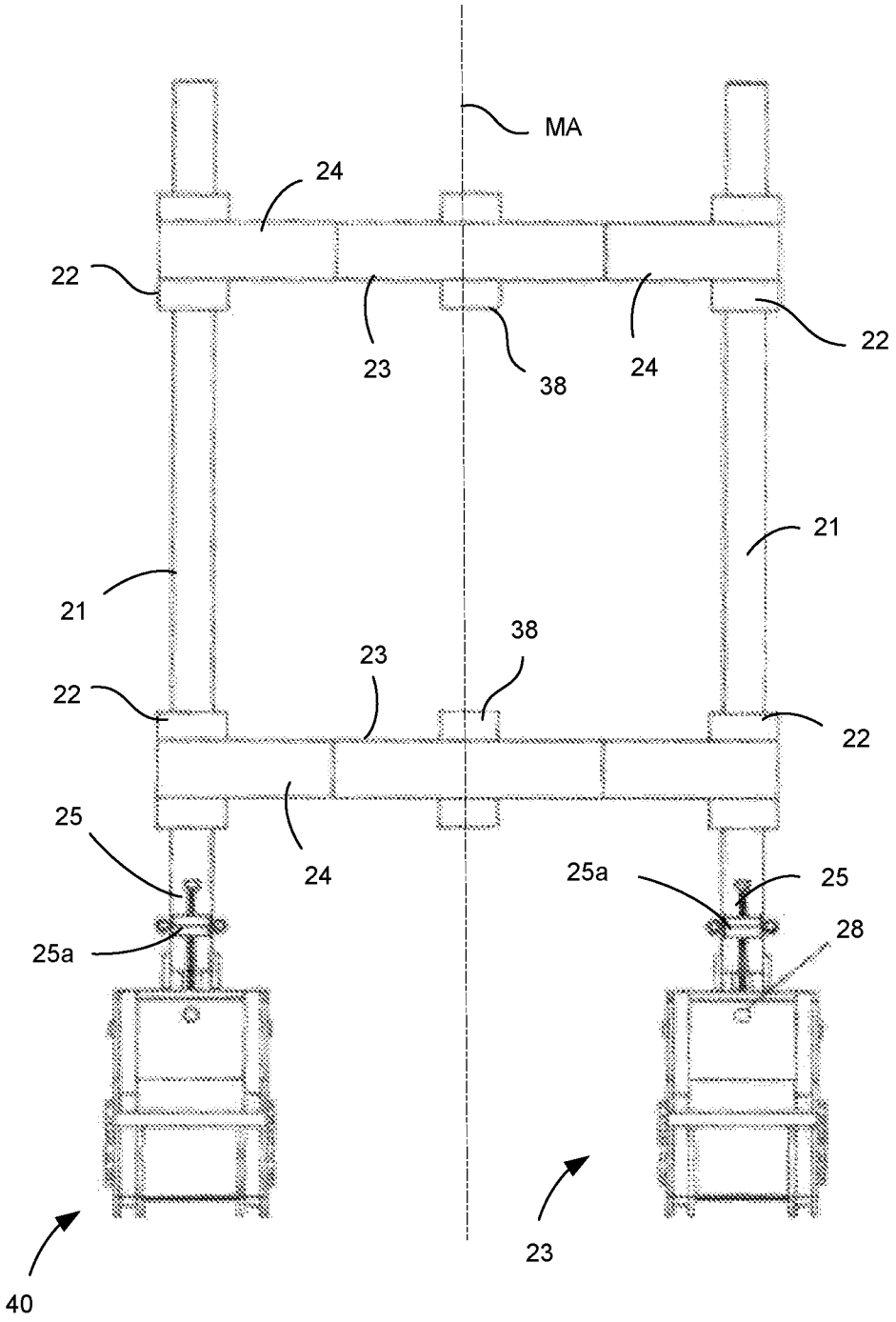
FIG. 5 is a schematic plan view of the counterbalance system shown in FIGS. 2-4.
Figure 6:
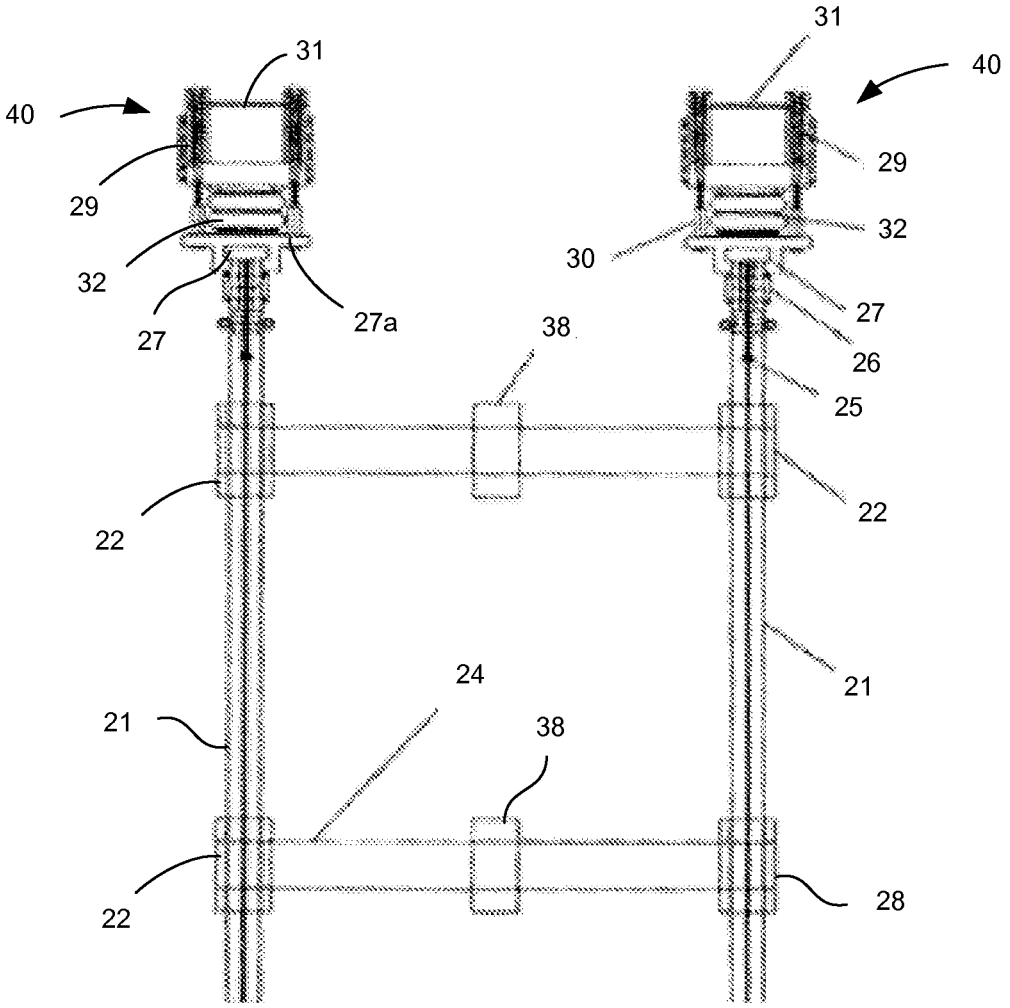
FIG. 6 is a schematic of the bottom view of the counterbalance system shown in FIGS. 2-5.
Figure 7:
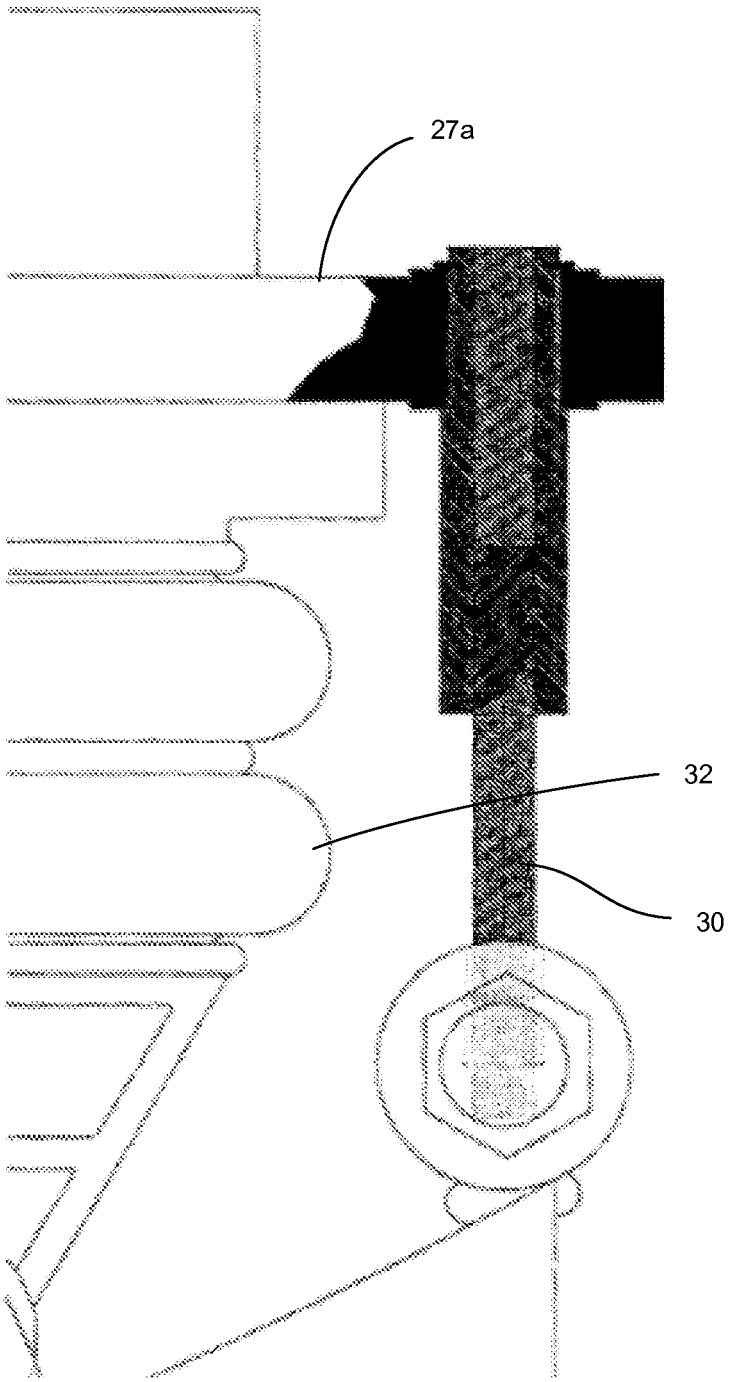
FIG. 7 is a schematic side view showing an embodiment of an adjustable suspension bolt of an embodiment of the adjustable head shown in FIGS. 2-6.
Figure 8:
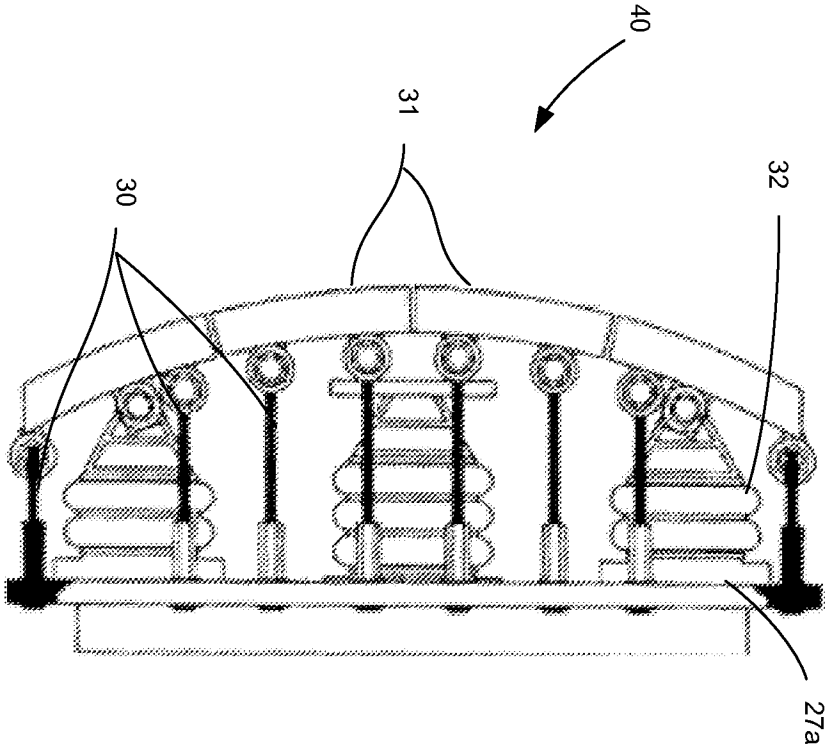
FIG. 8 is a schematic side view of the adjustable head shown in FIGS. 2-6.

Transverse beams 23 and 24 extend transverse to walking beam 10 and together provide a structure from which outrigger members 21 may be suspended from the walking beam. A separate set of transverse beams 23 and 24 is provided fore and aft of walking beam pivot axis WA in the illustrated embodiment. In each set, beam 23 extends over the top of walking beam 10 with beam segments 24 on either side of the walking beam. In the illustrated example, and as shown in the views of FIGS. 5 and 6, each beam segment 23 is associated with a flange 38 which represents an area of increased contact surface with the walking beam to facilitate bolting or clamping of the transverse beam arrangement (made up of beams 23 and 24) to the walking beam in a stable fashion to prevent the counterbalance arrangement from rotating about the longitudinal axis of the walking beam. Each set of transverse beam segments 24, one on each side of walking beam 10, and the bridging beam segment 23 forms a saddle around the adjacent walking beam section. A connecting strap (not shown) may pass under the said section of walking beam to affix to each beam section 24, in effect enclosing around the walking beam section. It will be appreciated that the height of the transverse beam section 24 in the illustrated counterbalance system determines the relative vertical position of the outrigger members 21 and functions to shift the center of gravity as described above. It will also be noted by comparing FIGS. 5 and 3 that the outrigger support structure defines a mounting axis MA, and that this mounting axis aligns in a vertical plane with the longitudinal axis of the walking beam 10 when the counterbalance system is mounted in the operating position on the walking beam.

In the illustrated example shown particularly in FIGS. 2 and 3, the counterbalance weight is provided by a respective set of components 34, 35, and 36 suspended from the suspension end of a respective one of the outrigger members 21. In particular, each set of counterweight components includes an equalizer bar 36, a mounting bar 34, and a counterbalance weight 35. The transverse equalizer bar 36 is suspended from a respective outrigger member 21 on suspension cables 33 and provides a stable connection point for connecting mounting bar 34. The mounting bar in turns provide connection points for connecting the counterbalance weight 35. It will be noted that in the installation shown in FIGS. 2 and 3, the counterweight components 34, 35, and 36 overhang the reducer gear 14; however, the width between the two sets of counterweight components prevents interference with the reducer gear 14 while providing adequate stroke movement and ground clearance.

Counterweights 35 can be recycled from their previous crankshaft placement on the pre-existing pumping unit or can be OEM weights provided with the counterbalance system. If the counterweights 35 are recycled from the pre-existing pumping unit, the mounting points on the transverse equalizer bar 36 may be customized to match those of the pumping unit crank 15. Using dedicated OEM counterweights can standardize the mounting points on the transverse equalizer bar 36. The amount of counterweight used can be equal to that required for typical crankshaft balancing. Completion of balance with the counterbalance system in place can be accomplished by sliding the outrigger members 21 forward or aft relative to the mounts 22 and walking beam 10, thereby moving these counterweights to reach the desired balance end point.

Each illustrated counterbalance head 40 is adjustably connected to its respective outrigger member 21. Tilt adjustment is facilitated by hinge pin 26 and tilt adjustment screws 25 above and below the hinge pin. In particular curved head complex tilt adjustment screws 25 pass through threaded holes in a terminal rigid mount 25*a* on the top and bottom of the respective outrigger member 21 to press against the mounting plate 27 which tilts by means of the hinge pin 26. Screw adjustment allows proper positioning of the counterbalance head to facilitate vertical translation accuracy of the suspension cables 33 and the counterbalance components 34, 35, and 36.

The illustrated counterbalance head mounting arrangement also facilitates adjustment to the vertical height of the respective counterbalance head 40 relative to the walking beam pivot axis. This vertical adjustment arrangement includes a vertical height adjustment screw 28 which is threaded through a hole in a structurally dense plate that comprises the top portion of the respective counterbalance head 40. The vertical height adjustment screw 28 may be threaded downwardly to push down on the terminal end mounting flange 27, thus raising the counterbalance head through an articulating slot on the counterbalance head mounting plate 27*a* into which mounting flange 27 slides. The top plate through which adjustment screw 28 passes has two grooved channels in the top surface that receives and transmits the suspending cables 33 which originate at the terminal ends of the outrigger members 21. The top plate also affixes the chain conduit 29 that directs and supports the suspending cables against the curved front face of the counterbalance head 40. The top structural plate is rigidly affixed to the counterbalance head mounting plate 27*a*.

The illustrated counterbalance heads 40 have a front face which is adjustable to approximate different curvatures to match the curvature of the face of the horse head 11. The adjustability is facilitated by the separate front face plates 31 which make up the front face of the respective counterbalance head 40. The position of each plate 31 is adjustable via bolts 30 which are provided to bridge between the plate 27*a* and the respective face plate 31. At the back plate 27*a*, a respective bolt 30 is threaded through a bushing nut which can be rotated to lengthen and shorten that respective bolt. The threaded bolts 30 terminate at the other end into threaded holes in articulating pins that pass through fixed bushings affixed to the back of the front face plates 31. Bolts 30 act as structural members for the respective face plate 31. By lengthening or shortening these bolts in concert over the span of the curved head complex, the curvature of the front face of the curved head complex can be changed. These bolts form structural rows on either side of the given counterbalance head 40.

The front face plates 31 of the respective counterbalance head 40 are curved, channeled structural plates which in unison create the front face of the counterbalance head and collectively define collectively the radius of curvature of the front face of the counterbalance head. The air bag structural members 32 affix or abut against the rear of the front face plates 31 to reinforce the rigidity of the plate section. To improve the continuity of the non-contiguous collective curvatures of the front face plates, a specialized chain conduit 29 travels along grooved channels on each side of the front face plates 31. The chain conduit 29 affixes to the top plate of the head complex and follows channel-like grooves within the individual front face plates and are held in position by pressure from the overlying suspension cable within a spine formed channel of the chain. An excess of chain extends beyond the lower edge of the counterbalance head and redundantly extends and affixes to the bottom edge of the curved head mounting back plate. As the head expands with steeping of the radius of curvature, the excess chain moves onto the front face, which keeps the cable groove continuous. Each curved counterbalance head has two grooved chain conduits for two cables per head.

Air bag structural members 32 form a central line within the counterbalance head to create an adjustable reinforcement of the adjustable counterbalance head to resist compressive collapse from forces of the loaded suspension cables and the outrigger beams as the downward force of the counterweights resists deflection by the curved front surface of the curved face of the counterbalance head. These air bag structural members 32 can be inflated or deflated through needle valves to maintain the desired radius of curvature as adjusted by the suspension bolts 30 while imparting adequate structural rigidity.

The suspension cables 33 originate as a loop through an eyelet in the terminal end of the respective outrigger member 21, follow ring eyelets at the top of outrigger member where the loops close atop the beams with cable clamping devices, and extend over the top of the counterbalance head to follow the grooves and chain conduits as described above. As the walking beam 10 tilts, the radius of curvature of the counterbalance head 40 keeps the suspension cable within the prescribed vertical path. The suspension cables 33 terminate in eyelets on the transverse equalizer bar 36 of the respective counterbalance arrangement (34, 35, and 36.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A counterbalance system for a pumping unit, the counterbalance system including:

(a) a outrigger support structure adapted to be mounted in an operating position on a walking beam of a pumping unit, the outrigger support structure in the operating position extending transverse to the walking beam from a first lateral side of the counterbalance system at a first side of the walking beam to a second lateral side of the counterbalance system at a second side of the walking beam opposite the first side of the walking beam, the outrigger support structure having a mounting axis which aligns in a vertical plane with the longitudinal axis of the walking beam when the outrigger support structure is mounted in the operating position on the walking beam;

(b) a first elongated outrigger member connected to the outrigger support structure at the first lateral side of the counterbalance system with a suspension end of the first outrigger member positioned on the first lateral side of the counterbalance system, the first outrigger member being connected to the outrigger support structure so that the longitudinal axis of the first outrigger member extends along the mounting axis;

(c) a second elongated outrigger member connected to the outrigger support structure at the second lateral side of the counterbalance system with a suspension end of the second outrigger member positioned on the second lateral side of the counterbalance system, the second outrigger member being connected to the outrigger support structure so that the longitudinal axis of the second outrigger member extends along the mounting axis;

(d) a first suspension element connected to the first outrigger member so as to depend from the suspension end of the first outrigger member when the outrigger support structure is in the operating position, the first suspension element adapted to receive a first counterbalance weight and suspend the first counterbalance weight from the first outrigger member when the outrigger support structure is in the operating position; and (e) a second suspension element connected to the second outrigger member so as to depend from the suspension end of the second outrigger member when the outrigger support structure is in the operating position, the second suspension element adapted to receive a second counterbalance weight and suspend the second counterbalance weight from the second outrigger member when the outrigger support structure is in the operating position.

2. The counterbalance system of claim 1 further including:

(a) a first mount connected to the outrigger support structure at the first lateral side of the counterbalance system, the first mount adapted to slideably receive the first outrigger member so that the position of the first outrigger member relative to the first mount is adjustable along the longitudinal axis of the first outrigger member; and (b) a second mount connected to the outrigger support structure at the second lateral side of the counterbalance system, the second mount adapted to slideably receive the second outrigger member so that the position of the second outrigger member relative to the first mount is adjustable along the longitudinal axis of the second outrigger member.

3. The counterbalance system of claim 1 wherein the first and second outrigger members are connected to the outrigger support structure so that the longitudinal axis of the first outrigger member extends parallel to the longitudinal axis of the second outrigger member.

4. The counterbalance system of claim 3 wherein the outrigger support structure includes:

(a) a rear support element; and (b) a forward support element, the forward support element residing proximate to a front of the walking beam when the outrigger support structure is in the operating position, with the rear support element residing relatively further away from the front of the walking beam.

5. The counterbalance system of claim 4 further including:

(a) a forward first side mount connected to the forward support element at the first lateral side of the counterbalance system, the forward first side mount adapted to slideably receive the first outrigger member so that the position of the first outrigger member relative to the forward first side mount is adjustable along the longitudinal axis of the first outrigger member;

(b) a rear first side mount connected to the rear support element at the first lateral side of the counterbalance system, the rear first side mount adapted to slideably receive the first outrigger member so that the position of the first outrigger member relative to the rear first side mount is adjustable along the longitudinal axis of the first outrigger member;

(c) a forward second side mount connected to the forward support element at the second lateral side of the counterbalance system, the forward second side mount adapted to slideably receive the second outrigger member so that the position of the second outrigger member relative to the forward second side mount is adjustable along the longitudinal axis of the second outrigger member; and (d) a rear second side mount connected to the rear support element at the second lateral side of the counterbalance system, the rear second side mount adapted to slideably receive the second outrigger member so that the position of the second outrigger member relative to the rear second side mount is adjustable along the longitudinal axis of the second outrigger member.

6. The counterbalance system of claim 1 wherein the first and second outrigger members reside below the level of the walking beam and the counterbalance system is positioned axially along the walking beam when the outrigger support structure is in the operating position so as to place the center of gravity of a structure comprising the walking beam, the outrigger support structure, and the first and second outrigger members at a pivot axis for the walking beam on the pumping unit.

7. The counterbalance system of claim 1 further including:

(a) a first counterbalance head mounted at the suspension end of the first outrigger member, the first counterbalance head having a curved face with a curvature which approximates a curvature of a head of the pumping unit;

(b) a second counterbalance head mounted at the suspension end of the second outrigger member, the second counterbalance head having a curved face with a curvature which approximates the curvature of the head of the pumping unit; and (c) wherein the first suspension element extends over the curved face of the first counterbalance head, and the second suspension element extends over the curved face of the second counterbalance head.

8. The counterbalance system of claim 7 wherein the first and second outrigger members reside below the level of the walking beam and the counterbalance system is positioned axially along the walking beam when the outrigger support structure is in the operating position so as to place the center of gravity of a structure comprising the walking beam, a pumping unit head connected to the walking beam, the outrigger support structure, the first and second outrigger members, and the first and second counterbalance heads at a pivot axis for the walking beam on the pumping unit.

9. A pumping unit including:

(a) a base structure;

(b) a walking beam pivotally connected to the base structure as to be pivotable with respect to the base structure about a walking beam pivot axis;

(c) a pumping unit head connected to a forward end of the walking beam;

(d) a outrigger support structure mounted in an operating position on the walking beam, the outrigger support structure in the operating position extending transverse to the walking beam from a first side of the walking beam to a second side of the walking beam opposite the first side of the walking beam, the outrigger support structure having a mounting axis which aligns in a vertical plane with the longitudinal axis of the walking beam when the outrigger support structure is mounted in the operating position on the walking beam;

(e) a first elongated outrigger member connected to the outrigger support structure at the first side of the walking beam with a suspension end of the first outrigger member positioned on the first side of the walking beam, the first outrigger member being connected to the outrigger support structure so that the longitudinal axis of the first outrigger member extends along the mounting axis, the suspension end of the first outrigger member being adapted to receive the weight of a first counterbalance weight; and (f) a second elongated outrigger member connected to the outrigger support structure at the second side of the walking beam with a suspension end of the second outrigger member positioned on the second side of the walking beam, the second outrigger member being connected to the outrigger support structure so that the longitudinal axis of the second outrigger member extends along the mounting axis, the suspension end of the second outrigger member being adapted to receive the weight of a second counterbalance weight.

10. The pumping unit of claim 9 further including:

(a) a first mount connected to the outrigger support structure at the first side of the walking beam, the first mount adapted to slideably receive the first outrigger member so that the position of the first outrigger member relative to the first mount is adjustable along the longitudinal axis of the first outrigger member; and (b) a second mount connected to the outrigger support structure at the second side of the walking beam, the second mount adapted to slideably receive the second outrigger member so that the position of the second outrigger member relative to the second mount is adjustable along the longitudinal axis of the second outrigger member.

11. The pumping unit of claim 9 wherein the first and second outrigger members are connected to the outrigger support structure so that the longitudinal axis of the first outrigger member extends parallel to the longitudinal axis of the second outrigger member.

12. The pumping unit of claim 11 wherein the outrigger support structure includes:

(a) a rear support element; and (b) a forward support element, the forward support element residing proximate to a front of the walking beam when the outrigger support structure is in the operating position, with the rear support element residing relatively further away from the front of the walking beam.

13. The pumping unit of claim 12 further including:

(a) a forward first side mount connected to the forward support element at the first side of the walking beam, the forward first side mount adapted to slideably receive the first outrigger member so that the position of the first outrigger member relative to the forward first side mount is adjustable along the longitudinal axis of the first outrigger member;

(b) a rear first side mount connected to the rear support element at the first side of the walking beam, the rear first side mount adapted to slideably receive the first outrigger member so that the position of the first outrigger member relative to the rear first side mount is adjustable along the longitudinal axis of the first outrigger member;

(c) a forward second side mount connected to the forward support element at the second side of the walking beam, the forward second side mount adapted to slideably receive the second outrigger member so that the position of the second outrigger member relative to the forward second side mount is adjustable along the longitudinal axis of the second outrigger member; and (d) a rear second side mount connected to the rear support element at the second side of the walking beam, the rear second side mount adapted to slideably receive the second outrigger member so that the position of the second outrigger member relative to the rear second side mount is adjustable along the longitudinal axis of the second outrigger member.

14. The pumping unit of claim 9 wherein the first and second outrigger members reside below the level of the walking beam and are positioned axially along the walking beam when the outrigger support structure is in the operating position so as to place the center of gravity of a structure comprising the walking beam, the outrigger support structure, and the first and second outrigger members at a pivot axis for the walking beam on the pumping unit.

15. The pumping unit of claim 9 further including:

(a) a first counterbalance head mounted at the suspension end of the first outrigger member, the first counterbalance head having a curved face with a curvature which approximates a curvature of the pumping unit head; and (b) a second counterbalance head mounted at the suspension end of the second outrigger member, the second counterbalance head having a curved face with a curvature which approximates the curvature of the pumping unit head.

16. The pumping unit of claim 15 wherein the first and second outrigger members reside below the level of the walking beam and are positioned axially along the walking beam when the outrigger support structure is in the operating position so as to place the center of gravity of a structure comprising the walking beam, a pumping unit head connected to the walking beam, the outrigger support structure, the first and second outrigger members, and the first and second counterbalance heads at a pivot axis for the walking beam on the pumping unit.

17. A pumping unit including:

(a) a walking beam support;

(b) a walking beam complex including a walking beam pivotally connected to the walking beam support so as to be pivotable with respect to the walking beam support about a walking beam pivot axis;

(c) a outrigger support structure mounted on the walking beam;

(d) a first outrigger complex including a first outrigger member connected to the outrigger support structure so as to reside on a first lateral side of the walking beam;

(e) a second outrigger complex including a second outrigger member connected to the outrigger support structure so as to reside on a second lateral side of the walking beam opposite the first lateral side thereof; and (f) the first and second outrigger complexes being positioned below the level of the walking beam and axially along the walking beam so as to place the center of gravity of the combined walking beam complex, outrigger support structure, first outrigger complex, and second outrigger complex at a pivot axis for the walking beam on the pumping unit.

18. The pumping unit of claim 17 further including:

(a) a first mount connected to the outrigger support structure on the first lateral side of the walking beam, the first mount adapted to slideably receive the first outrigger member so that the position of the first outrigger member relative to the first mount is adjustable along a longitudinal axis of the first outrigger member; and (b) a second mount connected to the outrigger support structure on the second lateral side of the walking beam, the second mount adapted to slideably receive the second outrigger member so that the position of the second outrigger member relative to the second mount is adjustable along a longitudinal axis of the second outrigger member.

19. The pumping unit of claim 17 wherein the outrigger support structure includes:

(a) a rear support element; and (b) a forward support element, the forward support element residing proximate to a front of the walking beam and the rear support element residing relatively further away from the front of the walking beam.

20. The pumping unit of claim 19 further including:

(a) a forward first side mount connected to the forward support element on the first lateral side of the walking beam, the forward first side mount adapted to slideably receive the first outrigger member so that the position of the first outrigger member relative to the forward first side mount is adjustable along a longitudinal axis of the first outrigger member;

(b) a rear first side mount connected to the rear support element on the first lateral side of the walking beam, the rear first side mount adapted to slideably receive the first outrigger member so that the position of the first outrigger member relative to the rear first side mount is adjustable along the longitudinal axis of the first outrigger member;

(c) a forward second side mount connected to the forward support element on the second lateral side of the walking beam, the forward second side mount adapted to slideably receive the second outrigger member so that the position of the second outrigger member relative to the forward second side mount is adjustable along a longitudinal axis of the second outrigger member; and (d) a rear second side mount connected to the rear support element on the second lateral side of the walking beam, the rear second side mount adapted to slideably receive the second outrigger member so that the position of the second outrigger member relative to the rear second side mount is adjustable along the longitudinal axis of the second outrigger member.

* * * * *